US006203348B1

(12) United States Patent
Fukuda

(10) Patent No.: US 6,203,348 B1
(45) Date of Patent: Mar. 20, 2001

(54) WATERPROOF CONNECTOR AND WATERPROOF RUBBER MEMBER

(75) Inventor: Masaru Fukuda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/348,679

(22) Filed: Jul. 6, 1999

(30) Foreign Application Priority Data

Jul. 6, 1998 (JP) ..... 10-190716

(51) Int. Cl.[7] ..... H01R 13/52

(52) U.S. Cl. ..... 439/275; 439/271; 439/587

(58) Field of Search ..... 439/275, 274, 439/271, 272, 273, 587, 588, 589, 279

(56) References Cited

U.S. PATENT DOCUMENTS

| | | | |
|---|---|---|---|
| 4,083,902 | | 4/1978 | Clyde . |
| 4,640,567 | | 2/1987 | Lundergran et al. . |
| 4,643,506 | * | 2/1987 | Kobler ..... 439/587 |
| 4,662,692 | | 5/1987 | Uken et al. . |
| 4,684,187 | | 8/1987 | Rudy, Jr. et al. . |
| 4,713,021 | | 12/1987 | Kobler . |
| 4,776,813 | | 10/1988 | Wilson et al. . |

(List continued on next page.)

FOREIGN PATENT DOCUMENTS

| | | |
|---|---|---|
| 0 299 797 | 1/1989 | (EP) . |
| 0 631 344 A2 | 12/1994 | (EP) . |
| 0 691 710 | 1/1996 | (EP) . |
| 2 415 375 | 1/1979 | (FR) . |
| 2 753 008 | 3/1998 | (FR) . |
| 2 168 548 | 6/1986 | (GB) . |
| 2 321 346 | 7/1998 | (GB) . |
| 2 321 347 | 7/1998 | (GB) . |
| 50-54591 | 5/1975 | (JP) . |
| 61-1261 | 4/1986 | (JP) . |
| 62-188069 | 11/1987 | (JP) . |
| 64-63282 | 3/1989 | (JP) . |
| 4-49480 | 4/1992 | (JP) . |
| 4-101380 | 9/1992 | (JP) . |
| 5-152028 | 6/1993 | (JP) . |
| 7-22079 | 1/1995 | (JP) . |
| 7-122331 | 5/1995 | (JP) . |
| 07201395 | 8/1995 | (JP) . |
| 07326424 | 12/1995 | (JP) . |
| 1-63282 | 10/1996 | (JP) . |
| 11-329571 | 11/1999 | (JP) . |
| 92/15133 | 9/1992 | (WO) . |
| 96/32760 | 10/1996 | (WO) . |
| 97/36346 | 10/1997 | (WO) . |
| 97/96346 | 10/1997 | (WO) . |

* cited by examiner

*Primary Examiner*—Paula Bradley
*Assistant Examiner*—Tho D. Ta
(74) *Attorney, Agent, or Firm*—Finnegan, Henderson, Farabow, Garrett & Dunner, L.L.P.

(57) ABSTRACT

An inner housing (12) is formed with terminal accommodation chambers (13) for accommodating therein terminals (14) at ends of wires (20). An outer housing (17) is formed with wire insertion holes (49) at a bottom wall portion (47) thereof in opposition to the terminal accommodation chambers, the bottom wall portion having rubber plug reception recesses (48) at locations on an inside thereof in opposition to the wire insertion holes. A spacer (28) has a hollow trunk portion (40) fitted on the inner housing and adapted to be fitted in the outer housing together with the inner housing, and a bottom wall portion (43) thereof formed with wire leading cavities (44). A waterproof rubber plug (5) for sealing the terminal accommodation chambers comprises a plate portion 52, first rubber plug portions (51) formed on one side of the plate portion and fitted tight in the rubber plug reception recesses, second plug portions (51) formed on the other side of the plate portion and fitted tight in the wire leading cavities, and wire leading holes (53) each provided through a first plug portion, the plate portion and a second plug portion.

8 Claims, 3 Drawing Sheets

U.S. PATENT DOCUMENTS

| | | | | |
|---|---|---|---|---|
| 4,944,688 | | 7/1990 | Lundergran . | |
| 4,976,634 | | 12/1990 | Green et al. . | |
| 5,116,236 | | 5/1992 | Colleran et al. . | |
| 5,240,431 | | 8/1993 | Yagi et al. . | |
| 5,498,170 | | 3/1996 | Tanaka . | |
| 5,529,508 | * | 6/1996 | Chiotis et al. | 439/589 |
| 5,562,477 | | 10/1996 | Moore et al. . | |
| 5,580,264 | | 12/1996 | Aoyama et al. . | |
| 5,613,868 | | 3/1997 | Ohsumi et al. . | |
| 5,645,451 | * | 7/1997 | Ohsumi et al. | 439/587 |
| 5,707,251 | | 1/1998 | Sakai et al. . | |
| 5,709,563 | | 1/1998 | Saito . | |
| 5,782,657 | | 7/1998 | Wolla et al. . | |
| 5,836,788 | | 11/1998 | Torii . | |
| 5,931,699 | | 8/1999 | Saito . | |
| 6,053,753 | * | 4/2000 | Kunkle | 439/275 |
| 6,116,938 | * | 9/2000 | Myer et al. | 439/271 |

WATERPROOF CONNECTOR AND WATERPROOF RUBBER MEMBER

BACKGROUND OF THE INVENTION

1. Field of the Invention

The present invention relates to a waterproof connector of a compact multi-polar type that has an enhanced waterproof nature between a connector housing assembly and a plurality of electric wires provided with terminals attached to their ends, as well as a waterproof rubber member therefor.

2. Description of the Relevant Art

Such a type of waterproof connector is disclosed in Japanese Patent Japanese Publication No. 11-329571 filed in Japan by the assignee of the present application.

This waterproof connector comprises: a connector housing assembly having a terminal accommodation cavity (to be waterproofed), and a number of separated wire leading cavities which communicate at their rear ends with outside via a number of first wire insertion holes formed through an outer rear wall (as a so-called "bottom wall" portion) of the housing assembly and at their front ends with the terminal accommodation cavity via a number of second wire insertion holes formed through an inner rear wall of the housing assembly; a number of rubber plugs fitted in the wire leading cavities and formed with wire leading holes; a number of female terminals set in positions in the terminal accommodation cavity; and a number of insulated electric wires lead via the first wire insertion holes, the wire leading holes and the second wire insertion holes into the terminal accommodation cavity, where they are connected at their front ends to the terminals.

The housing assembly comprises a waterproof outer housing formed with the outer rear wall, a waterproof spacer formed with the inner rear wall and fitted in and locked to the outer housing, and a waterproof inner housing formed with partially exposed partition walls and fitted in and locked to the spacer. Each wire leading cavity is defined by a recess in the outer rear wall closed with the inner rear wall.

The terminal accommodation cavity is defined by the spacer and the inner housing and divided by the partition walls into a plurality of terminal accommodation chambers. To be waterproof, this cavity should be sealed watertight at its front end, where a number of mating terminals are plugged, and at its rear end, where the insulated electric wires are lead in for connection.

The front end of that cavity is sealed with a mating waterproof connector adapted therefor. The rear end of the cavity is sealed with the rubber plugs sufficiently compressed between the first and second rear walls, to fit watertight to walls of the wire leading cavities and insulators of the wires.

The outer housing may however be damaged for external causes, with a potential failure to keep the terminal accommodation chamber waterproof.

SUMMARY OF THE INVENTION

The present invention has been achieved with such points in view.

It therefore is an object of the present invention to provide a waterproof connector improved for a practical waterproof property to be ensured even with damage to an outer housing member, and a waterproof rubber member therefor.

To achieve the object, an aspect of the invention provides a waterproof connector comprising: an outer housing member having a first wall formed with a wire insertion hole and a first cavity; an inner housing assembly fitted in the outer housing member, the inner housing assembly defining therein a terminal accommodation cavity and having a second wall formed with a second cavity; a waterproof rubber member fitted watertight in the first and second cavities and formed with a wire leading hole; and an electric wire lead through the wire insertion hole and the wire leading hole to the terminal accommodation cavity.

According to this aspect of the invention, a terminal accommodation cavity is kept waterproof, normally, with a waterproof rubber member fitted watertight in both a first cavity in a first wall of an outer housing member and a second cavity in a second wall of an inner housing assembly and, when the outer housing member is damaged, with the waterproof rubber member fitted watertight in the second cavity.

Another aspect of the invention provides a waterproof connector comprising: an inner housing formed with a terminal accommodation chamber for accommodating therein a terminal at an end of a wire; and outer housing adapted to be assembled with the inner housing and formed with a wire insertion hole at a bottom wall portion thereof in opposition to the terminal accommodation chamber, the bottom wall portion having a rubber plug reception recess at a location on an inside thereof in opposition to the wire insertion hole; a spacer having a hollow trunk portion fitted on the inner housing and adapted to be fitted in the outer housing together with the inner housing, and a bottom wall portion thereof formed with a wire leading cavity; and a waterproof rubber plug for sealing the terminal accommodation chamber, the waterproof rubber plug having a first rubber plug portion fitted tight in the rubber plug reception recess, a second plug portion fitted tight in the wire leading cavity, and a wire leading hole provided through the first and second plug portions for the wire to be lead watertight therethrough into the inner housing.

According to this aspect of the invention, a second plug portion fitted tight in a wire leading cavity seals an interior region of a spacer, even if an outer housing is damaged with a failure to keep therein waterproof.

Further, to achieve the object described, another aspect of the invention provides a waterproof rubber member for waterproof connectors, comprising: a plate portion; a first plug portion formed on one side of the plate portion; a second plug portion formed on another side of the plate portion; and a wire leading hole provided through the first plug portion, the plate portion and the second plug portion.

According to this aspect of the invention, a wire leading hole is kept waterproof irrespective of peripheral conditions of a waterproof rubber member.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
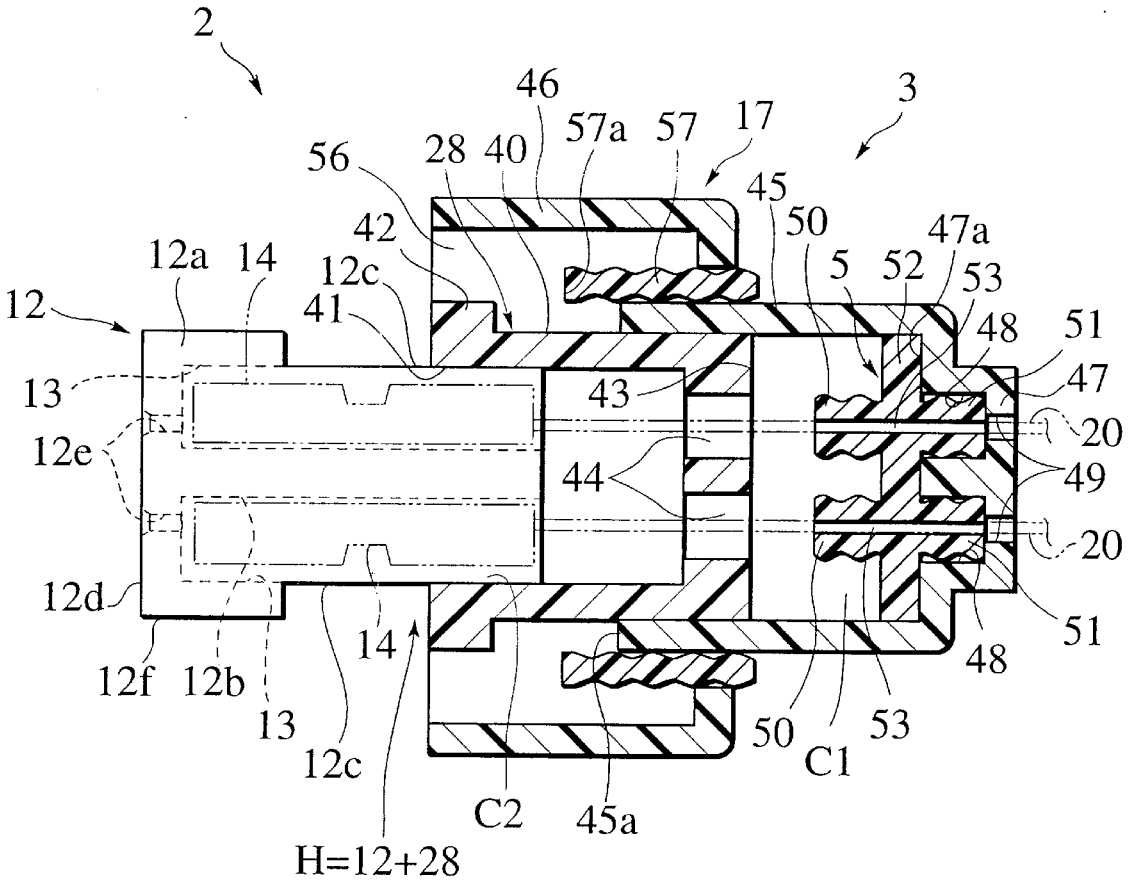
FIG. 1 is a longitudinal section of a waterproof connector according to an embodiment of the invention on a way of assemblage.

There will be detailed below the preferred embodiments of the present invention with reference to the accompanying drawings. Like members are designated by like reference characters.

Figure 2:
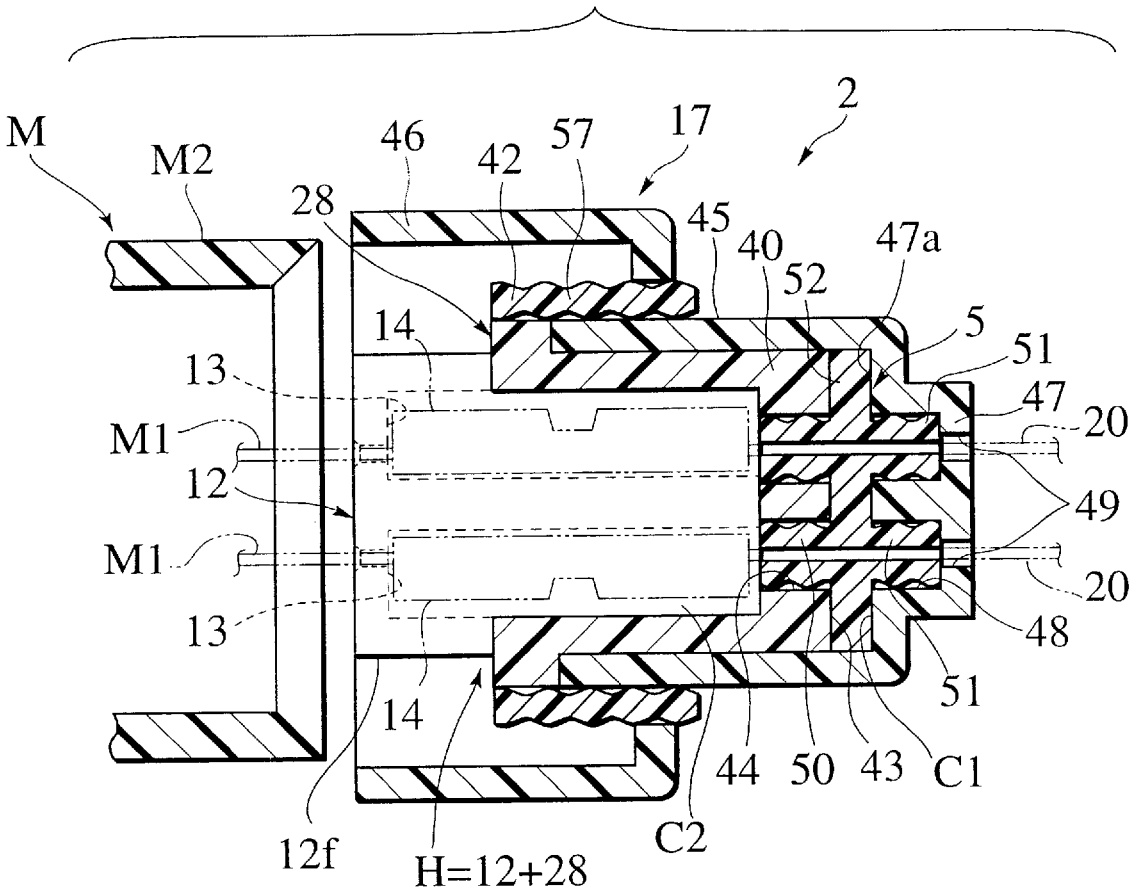
FIG. 2 is a longitudinal section of the waterproof connector of FIG. 1, as its is assembled and facing a mating waterproof connector.
Figure 3:
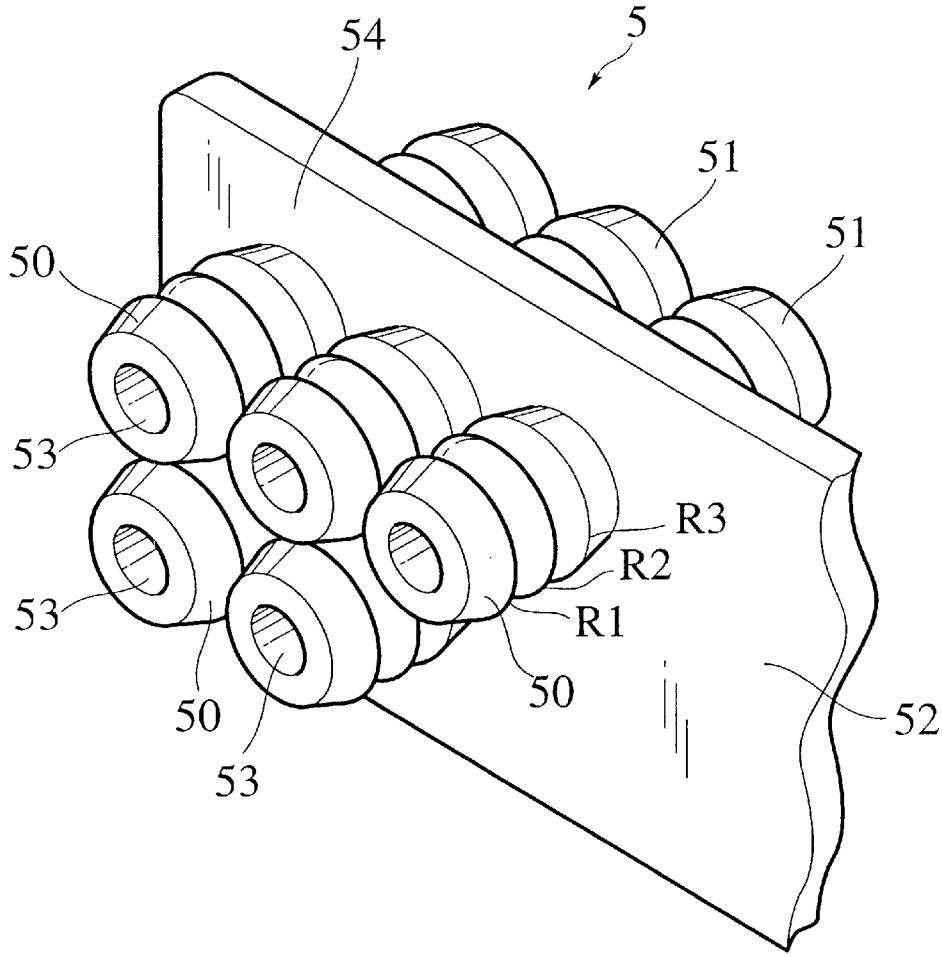
FIG. 3 is a perspective view of a waterproof rubber member of the waterproof connector of FIG. 1.

FIG. 1 illustrates a waterproof male connector 2 according to an embodiment of the invention on a way of assemblage, FIG. 2, an assembled state of the waterproof connector 2, and FIG. 3, a waterproof rubber plug member 5 in the connector 2.

As shown in FIGS. 1 and 2, the waterproof connector 2 comprises: a connector housing 3 of a male type defining therein a wire leading cavity C1 as a single connected space communicating with outside and a terminal accommodation cavity C2 as a single connected space communicating with the wire leading cavity C1 and partitioned into a pair of upper and lower arrays of terminal accommodation chambers 13; a waterproof rubber plug member 5 fitted watertight in the wire leading cavity C1, for sealing a wire connection end of the terminal accommodation cavity C2; a plurality of insulation displacement type female terminals 14 locked in positions in terminal accommodation chambers 13; and a plurality of insulated electric wires lead from outside, watertight through the waterproof rubber plug member 5, into terminal accommodation chambers 13, where they are connected to terminals 14 by contacting core wires of their non-stripped ends to insulation-displacing conductive blades of the terminals 14.

The connector housing 3 is component-wise molded with a synthetic resin flexible to a practical extent, and comprises: an inner housing assembly H composed of an inner housing 12 defining the terminal accommodation cavity C2 from ahead, and a spacer 28 fitted on the inner housing 12, defining the cavity C2 from behind; and an outer housing 17 fitted on the inner housing assembly H, more specifically on the spacer 28, defining the wire leading cavity C1 therebetween.

The inner housing 12 is a single mold comprising: a so-called box portion 12*a* composed of a vertical front wall 12*d* formed with upper and lower arrays of terminal insertion holes 12*e* for male contacts M1 of terminals of a mating waterproof female connector M to be plugged therein, and a front tubular wall 12*f* substantially square in section and extending rearward from a whole circumference of the front wall 12*d;* a horizontal central wall 12*b* extending rearward from an inside of the front wall 12*d,* with a larger horizontal length than the front tubular wall 12*f,* for partitioning the terminal accommodation cavity C2 into upper and lower cavity regions, when assembled; and upper and lower arrays of vertical partition walls 12*c* formed on the central wall 12*b,* with an identical horizontal length to the wall 12*b* and an identical vertical height to the upper and lower cavity regions, for partitioning the cavity regions into the terminal accommodation chambers 13.

The spacer 28 is a single mold configured so that the inner housing 12 conformally fits up the interior with the box portion 12*a* left outside, and comprises: a hollow trunk portion 40 as a so-called barrel portion having therein an axially straight tubular opening 41 and thereon an axially straight outer circumference 42 stepped at its front end to provide a flanged front edge for adaptation to abut on a rear edge of the front tubular wall of the box portion 12*a;* and a rear-end-closing vertical wall as a so-called bottom wall portion 43 having upper and lower arrays of wire leading cylindrical cavities 44 formed therethrough as a portion of the wire leading cavity C1 serving for communication between this cavity C1 and the terminal accommodation cavity C2.

The outer housing 17 is molded as two pieces: an inner wall portion 45 to be fitted on the spacer 28 with the cavity C1 defined therebetween, and an outer wall portion 46 fitted on the inner wall portion 45 with a waterproof rubber packing 57 inter-sealing therebetween. The inner wall portion 45 comprises: a straight cylindrical portion designed with a greater axial length than the trunk portion 40 of the spacer 28 so that the cavity C2 is defined with designed dimensions when a front edge of that portion is brought into abutment with the front end flange of the trunk portion 40; and a relatively thick rear wall portion as a so-called bottom wall portion 47 that has upper and lower arrays of wire leading cylindrical cavities or recesses 48 formed at inside thereof as a portion of the wire leading cavity C1 serving for communication of this cavity C1 with outside, and upper and lower arrays of wire insertion holes 49 formed at outside thereof as diameter-reduced communication holes between the recesses 48 and the outside. The outer wall portion 46 has a substantially identical axial length to the spacer 28, but has in section greater inside dimensions than the spacer 28 to define a front opening therebetween for a hood M2 of the mating female connector M to be fitted watertight between the rubber packing 57 and a rear part of the wall portion 46.

The waterproof rubber plug member 5 is a single rubber mold compressed tight in an entire region of the wire leading cavity C1, and comprises: a rectangular plate portion 52 compressed in a flat common portion of the cavity C1 between the bottom wall portion 43 of the spacer 28 and the bottom wall portion 47 of the inner wall portion 45 of the outer housing 17; upper and lower arrays of front plug portions as so-called individual rubber plug portions 50 integrally formed on and projecting in a normal direction of a front side of the plate portion 52, to be compressed to tight-fit in the wire leading cavities 44 of the spacer 28; and upper and lower arrays of rear plug portions as so-called rubber plug portions 51 integrally formed on and projecting in a normal direction of a rear side of the plate portion 52, to be compressed to tight-fit in the recesses 48 as wire leading cavities of the outer housing 17. A straight wire leading hole 53 is axially provided through a respective individual rubber plug portion 50, a corresponding part of the plate portion 52 and a corresponding rubber plug portion 51. Respective plug portions 50, 51 are each corrugated into a combination of relatively large lip R1, rim R2 and cone R3 on the outside and into very small ripples on the inside.

Non-stripped ends of insulated electric wires 20 are applied into wire insertion holes of the bottom wall portion 47 and lead through wire leading holes 53 of the waterproof rubber plug member 5 (and wire leading cavities C1 and 44, 48) into terminal accommodation chamber 13, where they are connected to insulation displacement blades of terminals 14.

There will be provided additional description in other words, for better comprehension.

Female terminals 14 of an insulation displacement type are accommodated in the terminal accommodation chambers 13, where they are locked in positions by unshown locking projections formed on a central horizontal wall 12*b*. The accommodation chambers 13 are provided in a space defined by a front wall 12*d* of a box portion 12*a* formed with terminal insertion holes 12*e* through which male terminals M1 of the mating connector M pass, as well as by the central horizontal wall 12*b,* and upper and lower vertical walls 12*c* serving as partition walls.

A spacer 28 has an almost rectangular hollow trunk portion 40 for an inner housing 12 to be fitted therein, which is fitted into an inner wall portion 45 of an outer housing 17. A front face portion of the hollow trunk portion 40 is opened so as to be fitted with the inner housing 12, and an outer face of this opening portion 41 is formed in an opening portion outer peripheral face 42 ascending stepwise outwardly. The opening portion outer peripheral face 42 abuts on an end face 45*a* of a front side of the inner wall portion 45 of the outer housing 17.

The hollow trunk portion 40 of the spacer 28 is sealed at its side opposed to the opening portion 41 by a bottom wall portion 43, and the bottom wall portion 43 is formed with wire insertion holes 44. Each of the wire insertion holes 44 has a large diameter so as to be brought in close contact with each of individual rubber plug portions 50 of a waterproof rubber plug member 5, where each of wires 20 has been inserted.

The outer housing 17 comprises the inner wall portion 45 formed in an almost rectangular tubular configuration and an almost rectangular tubular outer wall portion 46, and it is formed in a double walled box configuration opened at its front face portion. The hollow trunk portion 40 of the spacer 28 is fitted into the outer wall portion 45.

A rear end of the inner wall portion 45 of the outer housing 17 is sealed by a bottom wall portion 47. Rubber plug reception recesses 48, each having a large diameter and a circular sectional configuration, are respectively formed at positions of the bottom wall portion 47 opposed to the respective terminal accommodation chambers 13. Also, wire insertion holes 49 having a small diameter and communicating with the rubber plug reception recesses 48 are formed in the bottom wall portion 47.

A wide opening peripheral edge portion 47*a* is formed around a rubber plug reception recesses forming portion of the bottom wall portion 47 positioned on an inner housing 12 side, and a retaining plate portion 52 of the waterproof plug member 5 abuts on the opening peripheral edge portion 47*a*.

The outer housing 17 has a predetermined gap 56 between the outer wall portion 46 and the inner wall portion 45, and a hood M2 of a mating female connector M is inserted into the gap 56. An annular packing member 57 is attached between the outer wall portion 46 and the inner wall portion 45.

The annular packing member 57 of rubber or other suitable materials is held by the outer wall portion 46 in a state of the annular packing member 57 positioned along an outer face of the inner wall portion 45, and the annular packing member 57 thus held is fixed on the outer housing 17 by welding, adhering, or the like. The packing member 57 comes into close contact with the inner wall portion 45 along an outer face thereof, and it has an extending portion 57*a* from a front end of the inner wall portion 45 forwardly, and the extending portion 57*a* comes into close contact with the opening portion outer peripheral face 42 of the spacer.

As shown in FIGS. 1 and 3, the waterproof rubber plug member 5 comprises a plate-shaped retaining plate portion 52, a plurality of rubber plug portion 51 formed integrally and projectingly on one face of the retaining plate portion 52, and a plurality of individual rubber plug portions 50 formed integrally and projectingly on the other face thereof. The waterproof rubber plug member 5 as a whole is formed of insulating rubber. The plurality of rubber plug portions 51 and the plurality of individual rubber plug portion 50 on both the faces of the retaining plate portion 52 are opposed to each other, and wire insertion holes 53 through which wires 20 pass are respectively formed on the opposed rubber plug portions 51, individual rubber plug portions 50 and portions of the retaining plate portion 52.

The plurality of rubber plug portions 51 are respectively opposed to a plurality of rubber plug reception recesses 48 formed on the outer housing 17 and they are respectively received in the opposed rubber plug reception recesses 48 with close contact state. Also, the plurality of individual rubber plug portions 50 are extended from the retaining plate portion 52 toward the inner housing 2 side, and they are inserted into the wire insertion holes 44 of the spacer 28 to be received in close contact with the wire insertion holes 44. In order to achieve such close contacting, each of the rubber plug portions 51 and the individual rubber plug portions 50 has a corrugated or undulated outer configuration, as shown in FIG. 3.

The retaining plate portion 52 of the waterproof rubber plug member 5 has a portion 54 to be held (hereinafter referred to as "to-be-held portion"), which extends outward beyond portions where the rubber plug portions 51 and the individual rubber plug portions 50 are formed. The to-be-held portion 54 abuts on an opening peripheral edge 47*a* formed on the bottom wall portion 47 of the outer housing 17, and, with this abutment of the to-be-held portion 54, the spacer 28 is inserted into the outer housing 17, so that the to-be-held portion 54 is held or sandwiched between the bottom wall portion 43 of the spacer 28 and the opening peripheral edge 47*a*.

The retaining plate portion 52 of the embodiment is formed so as to have almost the same length and width as those of the inner wall portion 45 of the outer housing 17. The to-be-held portion 54 is held between the bottom wall portion 43 of the spacer 28 and the opening peripheral edge 47*a* of the outer housing 17 so that it covers all of the rubber plug reception recesses 48 and all of the wire insertion holes 44 of the spacer 28. Accordingly, the retaining plate portion 52 completely partitions the rubber plug reception recesses 48 and the terminal accommodation chambers 13 of the inner housing 12 from each other so that it can seal them.

When the waterproof connector 2 of the present embodiment is assembled, the wires 20 are caused to pass through the respective wire insertion holes 47 of the outer housing 17 from its outside. Then, tip ends of the respective wires 20 are caused to pass through the wire insertion holes 44 of the spacer 28 to be connected to respective pairs of pressure-contacting blades 14*b* of the female terminals 14 accommodated in the terminal accommodation chambers 13 of the inner housing 12.

Thereafter, the waterproof rubber plug member 5 is inserted into the inner wall portion 45 of the outer housing 17. This insertion is performed from the side of the rubber plug portions 51 so that the retaining plate portion 52 is caused to abut on the opening peripheral edge 47*a*. The plurality of rubber plug portions 51 are formed integrally with the retaining plate portion 52, and all of the rubber plug portions 51 are simultaneously inserted and received in the corresponding rubber plug reception recesses 48 when the retaining plate portion 51 is caused to abut on the opening peripheral edge 47*a*. Accordingly, it is unnecessary to insert individual and independent waterproof rubber plugs into the rubber plug reception recesses 48 individually and independently, thereby facilitating assembling of the waterproof rubber plug.

Next, the spacer 28 is inserted into the inner wall portion 45 of the outer housing 17. At this time, the plurality of individual rubber plug portions 50 of the waterproof rubber plug member 5 are respectively inserted and received in the respective wire insertion holes 44 formed on the bottom wall portion 43 of the spacer 28. The plurality of individual rubber plug portions 50 are formed integrally on the retaining plate portion 52, and all of the individual rubber plug portions 50 are simultaneously inserted and received in the corresponding wire insertion holes 44. Accordingly, like the rubber plug portions 51, it is unnecessary to insert the individual rubber plug portions 50 into the wire insertion holes 44 individually, thereby performing insertion easily.

In the state where the spacer 28 is completely fitted in the inner wall portion 45, the retaining plate portion 52 is held and fixed between the bottom wall portion 43 of the spacer 28 and the opening peripheral edge 47*a* of the outer housing 17. Accordingly, the waterproof rubber plug member 5 is prevented from coming off and it is fixed firmly. At this time, the retaining plate portion 52 of the waterproof rubber plug member 5 isolates and seals the terminal accommodation chambers 13 of the inner housing 12 from the rubber plug reception recesses 48 of the outer housing 17.

Also, the opening portion outer peripheral face 42 of the spacer 28 is fitted in an extending portion 57*a* of the packing member 57 assembled in the outer housing 17, so that the packing member 57 comes in close contact with the opening portion outer peripheral face 42. Accordingly, an abutment face between the spacer 28 and the inner wall portion 45 of the outer housing 17 is sealed.

Thereafter, the inner housing 12 is fitted into the hollow trunk portion 40 of the spacer 28 so that the assembling is completed, as shown in FIG. 2. After completion of the assembling, a forward end portion of the mating connector 4 is inserted and assembled into the outer wall portion 46 of the outer housing 17 so that the present waterproof connector is connected to the mating connector 4. At this time, the packing member 57 is held or sandwiched between the mating connector 4 and the opening portion outer peripheral face 42 of the spacer 28.

In the embodiment, as the individual rubber plug portions 50 of the waterproof rubber plug member 5 extends into the wire insertion holes 44 to come into close contact therewith, the wire insertion holes 44 are securely put in the waterproofed state. Accordingly, even when the waterproof connector of this embodiment is put in a severe using environment or any one of the rubber plug reception recesses 48 of the outer housing 17 is injured, water is prevented from entering in the inner housing 12 fitted in the spacer 28, so that a high reliable waterproof performance can be imparted to the waterproof connector.

Also, the retaining plate portion 52 formed integrally on the rubber plug portions 51 and the individual rubber plug portions 50 is held or sandwiched between the bottom wall portion 43 of the spacer 28 and the opening peripheral edge 47*a* of the rubber plug reception recesses 48 so that the entire waterproof rubber plug member 5 can be fixed. At this time, the plurality of rubber plug portions 51 are simultaneously in the rubber plug reception recesses 48, and the plurality of individual rubber plug portions 50 are also simultaneously inserted into the wire insertion holes 44. For this reason, attaching of the waterproof rubber plug member 5 can easily be performed.

In addition thereto, since the retaining plate portion 52 is held between the spacer 28 and the outer housing 17 to seal the rubber plug reception recesses 48 and the terminal accommodation chambers 13 of the inner housing 12, water can securely be prevented from entering into the respective terminal accommodation chambers 13.

Furthermore, in this embodiment, the packing member 57 is brought into contact with the opening portion outer peripheral face 42 of the spacer 42 from the outside by fitting the mating connector 4 to the outer housing 17. Accordingly, water is prevented from entering in between the spacer 28 and the outer housing 17, so that the waterproof connector of this embodiment can further be improved.

Figure 4:
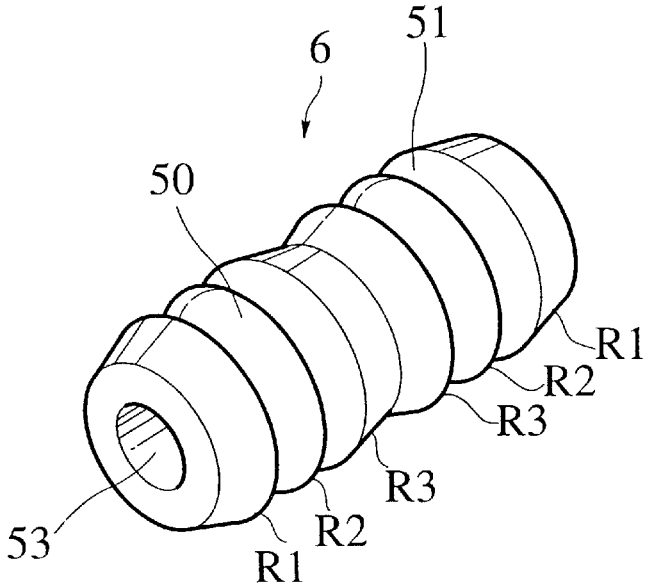
FIG. 4 is a perspective view of a waterproof rubber plug according to another embodiment of the invention.

FIG. 4 shows a waterproof rubber plug 6 in another embodiment. This waterproof rubber plug 6 is formed in an elongated configuration as a whole, and it has a through-hole 53 extending along its longitudinal direction. One side portion of the waterproof rubber plug 6 in the longitudinal direction is a rubber plug portion 51 inserted in a rubber plug reception recess 48 formed on a bottom wall portion 47 of a outer housing 17 to be brought in close contact therewith, and the other side portion thereof is an individual rubber plug portion 50 inserted into a wire insertion hole 44 formed in a bottom wall portion 43 of a spacer 28 to be brought in contact therewith.

In the waterproof rubber plugs 6 thus structured, wires 20 are let through wire insertion holes 53, and the rubber plug portions 51 on the one side are respectively inserted into the rubber plug reception recesses 48 of an outer housing 17 to be brought into close contact therewith. Then, in this state, the spacer 28 is fitted into an inner wall portion 45 of the outer housing 17, so that the individual rubber plug portions 50 on the other side are respectively inserted into the wire insertion holes 44 of the spacer 28 to be brought into contact therewith.

As the waterproof rubber plug 6 is inserted in the rubber plug reception recess 48 and the wire insertion hole 44 of the spacer 28, it can seal long the outer housing 17 to a terminal accommodation chamber 13 of an inner housing 12. Accordingly, even the waterproof connector having the waterproof rubber plugs 6 is used in a severe environment or any of the rubber plug reception recesses 48 is injured, water is prevented from entering into the inner housing 12 which has been fixed into the spacer 28, so that a high reliable waterproof performance can be given to the water proof connector having the waterproof plugs 6 like the first embodiment.

The packing member 57 may preferably be omitted. Terminals may each preferably be any solder-less type.

The waterproof rubber plug comprises rubber plug portions received in the rubber plug reception recesses, the individual rubber plug portions and a retaining plate portion formed integrally between the rubber plug portions and the individual rubber plug portions and held between the bottom wall portion of the spacer and an opening edge of the rubber plug reception recesses positioned on the inner housing side.

As a retaining plate portion formed integrally with rubber plug portions and individual rubber plug portions is held or sandwiched between a bottom wall portion of a spacer and an opening edge of rubber plug reception recesses positioned on an inner housing side, the entire waterproof rubber plug is fixed. Accordingly, it is unnecessary to insert waterproof rubber plugs into the rubber plug reception recesses individually, so that inserting work can be simplified and insertion can be performed in a short time period. Also, as the retaining plate portion is held between the spacer and an outer housing to seal the rubber plug reception recesses and terminal accommodation chambers of the inner housing, water can securely be prevented from entering in the terminal accommodation chambers. For this reason, a waterproof connector is improved in waterproof performance.

A packing member held between an opening portion outer peripheral face of the hollow trunk portion of the spacer positioned on an inner housing inserting side thereof and a mating connector is assembled into the outer housing.

Accordingly, a packing member is brought into close contact with an opening portion outer peripheral face of a spacer from the outside by fitting a waterproof connector with a mating connector. Water is prevented from entering in the waterproof connector from a clearance between the spacer and an outer housing, thereby further improving waterproof performance.

While preferred embodiments of the present invention have been described using specific terms, such description is for illustrative purposes, and it is to be understood that changes and variations may be made without departing from the spirit or scope of the following claims.

What is claimed is:

1. A waterproof connector comprising:

an outer housing member having a first wall defining a wire insertion hole and formed with a first cavity;

an inner housing assembly engageable with the outer housing member, the inner housing assembly defining therein a terminal accommodation cavity and having a second wall formed with a second cavity;

a waterproof rubber member configured to be fit watertight in the first and second cavities and defining a wire leading hole.

wherein said wire insertion hole and said wire leading hole are configured to receive an electric wire passing through the first and second cavities and to the terminal accommodation cavity.

2. The waterproof connector of claim 1, wherein the first wall has a plurality of wire insertion holes and a plurality of first cavities, the second wall has a plurality of second cavities, and the waterproof rubber member is further configured to be fit watertight in the plurality of first cavities and the plurality of second cavities.

3. The waterproof connector of claim 2, wherein the waterproof rubber member is configured to be fit watertight in a common cavity between the first and second walls communicating with the plurality of first cavities and the plurality of second cavities.

4. A waterproof connector comprising:

an inner housing formed with a terminal accommodation chamber for accommodating therein a terminal at an end of a wire;

an outer housing adapted to be assembled with the inner housing and defining a wire insertion hole at a bottom wall portion thereof in opposition to the terminal accommodation chamber, the bottom wall portion having a rubber plug reception recess at a location on an inside thereof in opposition to the wire insertion hole;

a spacer having a hollow trunk portion configured to be fit on the inner housing and adapted to be fit in the outer housing together with the inner housing, and a bottom wall portion thereof formed with a wire leading cavity; and a waterproof rubber plug member for sealing the terminal accommodation chamber, the waterproof rubber plug member having a first rubber plug portion configured to be tightly fit in the rubber plug reception recess, a second rubber plug portion configured to be tightly fit in the wire leading cavity, and a wire leading hole provided through the first and second plug portions for the wire to be lead watertight therethrough into the inner housing.

5. The waterproof connector of claim 4, wherein the bottom wall portion of the outer housing has a plurality of rubber plug reception recesses, the bottom wall portion of the spacer has a plurality of wire leading cavities, and the waterproof rubber plug member comprises a plate portion configured to be tightly fit in a common cavity between the bottom wall portion of the outer housing and the bottom wall portion of the spacer, a plurality of first rubber plug portions formed on one side of the plate portion and configured to be tightly fit in the plurality of rubber plug reception recesses, a plurality of second rubber plug portions formed on another side of the plate portion and configured to be tightly fit in the plurality of wire leading cavities.

6. The waterproof connector of claim 4, further comprising a packing member configured to form a watertight connection between the outer housing and a mating connector.

7. A waterproof rubber member for a waterproof connector, comprising:

a plate portion;

a plurality of first elongate plug portions extending from one side of the plate portion;

a plurality of second elongate plug portions extending from another side of the plate portion; and a wire leading hole provided through the first plug portion, the plate portion and the second plug portion, wherein said plurality of first and second plug portions are configured to be housed within said waterproof connector.

8. A waterproof connector comprising:

an outer housing member having a first wall defining a plurality of wire insertion holes and formed with a plurality of first cavities;

an inner housing assembly configured to be fit in the outer housing member, the inner housing assembly defining therein a terminal accommodation cavity and having a second wall formed with a plurality of second cavities;

a waterproof rubber member configured to be fit watertight in the plurality of first cavities and the plurality of second cavities and formed with a plurality of wire leading holes; and at least one electric wire configured to extend through one of the plurality of wire insertion holes and one of the plurality of wire leading holes to the terminal accommodation cavity.

* * * * *

UNITED STATES PATENT AND TRADEMARK OFFICE

CERTIFICATE OF CORRECTION

PATENT NO. : 6,203,348 B1
DATED : March 20, 2001
INVENTOR(S) : Masaru Fukude

It is certified that error appears in the above-identified patent and that said Letters Patent is hereby corrected as shown below:

Title page,
Item [54], line 2, "ASSEMBLING OF" should read – OF ASSEMBLING --.

Column 10,
Line 50, after "connector housing", insert – such that the terminal and the electric wire is --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,203,348 B1
DATED : March 20, 2001
INVENTOR(S) : Masaru Fukuda

It is certified that error appears in the above-identified patent and that said Letters Patent is hereby corrected as shown below:

Column 9,
Line 30, “hole.” should read -- hole, --.

This certificate supersedes Certificate of Correction issued November 27, 2001.

Signed and Sealed this

Nineteenth Day of November, 2002

*Attest:*

*Attesting Officer*

JAMES E. ROGAN
*Director of the United States Patent and Trademark Office*